United States Patent [19]

Hirose

[11] Patent Number: 4,676,178

[45] Date of Patent: Jun. 30, 1987

[54] ROTARY LOOPTAKER AND BOBBIN CASE WITH MAGNETIC REPULSIVE FORCE THEREBETWEEN

[76] Inventor: Tokuzo Hirose, 13-13, Higashiyamacho, Ashiya-shi, Hyogo-ken, Japan

[21] Appl. No.: 717,294

[22] Filed: Mar. 28, 1985

[30] Foreign Application Priority Data

Jan. 30, 1985 [JP] Japan ..... 60-17386

[51] Int. Cl.[4] ..... D05B 57/08; D05B 57/26

[52] U.S. Cl. ..... 112/231

[58] Field of Search ..... 112/181, 182, 183, 184, 112/196, 228, 229, 230, 231; 57/124; 384/446

[56] References Cited

U.S. PATENT DOCUMENTS

| | | | |
|---|---|---|---|
| 2,209,906 | 7/1940 | Rubel | 112/228 |
| 2,343,877 | 3/1944 | Zonis | 112/228 |
| 2,608,945 | 9/1952 | Hagquist | 112/181 |
| 2,690,726 | 10/1954 | Wener | 112/231 |
| 2,907,165 | 10/1959 | Adams et al. | 57/75 |
| 2,932,152 | 4/1960 | Jackson | 57/124 X |
| 3,122,876 | 3/1964 | Matsui | 57/124 |
| 3,146,744 | 9/1961 | Bradshaw | 112/232 |
| 3,851,448 | 12/1974 | Sano et al. | 57/124 X |

FOREIGN PATENT DOCUMENTS

| | | | |
|---|---|---|---|
| 526980 | 6/1956 | Canada | 112/231 |
| 2332029 | 1/1975 | Fed. Rep. of Germany | 57/124 |
| 83/00886 | 3/1983 | PCT Int'l Appl. | 112/184 |
| 679949 | 9/1952 | United Kingdom | 112/181 |

*Primary Examiner*—Wm. Carter Reynolds

*Attorney, Agent, or Firm*—Wenderoth, Lind & Ponack

[57] ABSTRACT

A rotary looptaker having an annular groove formed therein and a bobbin case having a track rib formed thereon, wherein the looptaker is driven for rotation with the annular rib fitted into the annular groove and permanent magnetic pieces are respectively provided in the annular rib and the annular groove so that magnetic repulsive forces are produced therebetween.

21 Claims, 6 Drawing Figures

ROTARY LOOPTAKER AND BOBBIN CASE WITH MAGNETIC REPULSIVE FORCE THEREBETWEEN

BACKGROUND OF THE INVENTION

1. Field of the Invention

The present invention relates to a rotary looptaker in a sewing machine, more particularly toan arrangement for avoiding trouble or problems due to friction caused by rotation between a looptaker and a bobbin case.

2. Description of the Prior Art in a conventional vertically rotary looptaker according to which a looptaker is driven to rotate with an annular rib of a bobbin case fitted into an annular groove of the looptaker, the rotational speed of the looptaker is at most 7,000 rpm, since the loopertaker and the bobbin case are made of iron. Even in the arrangements wherein lubricant oil is supplied to the annular groove of the looptaker and the annular rib of the bobbin case, the rotational speed is yet at most 12,000 rpm. In such a conventional mechanism, although sliding resistance is reduced by the lubricant oil, friction is still produced between the annular groove of the looptaker and the annular rib of the bobbin case. Besides, the use of the lubricant oil brings about attachment of oil to the thread thereby preventing the sewing operation from being smoothly performed.

SUMMARY OF THE INVENTION

To solve the aformentioned problem, it is an object of the present invention to provide an improved and novel rotary looptaker.

It is another object of the invention to provide a rotary looptaker wherein sliding resistance is reduced to enable the looptaker to rotate at a high speed and soiling of the thread due to oil is prevented.

To accomplish the above objects, in a rotary looptaker being of the type comprising a looptaker having an annular groove formed therein and a bobbin case having an annular rib formed thereon, said looptaker being driven for rotation with the annular rib of the bobbin case fitted into the annular groove of the looptaker, the improvement in accordance with the invention comprises means for producing a repulsive magnetic force acting between the annular groove and the annular rib.

In a preferred embodiment, said repulsive magnetic force producing means comprises a first permanent magnet means provided on both sides of the annular rib and a second permanent magnet means secured to both interior sides of the annular groove in opposite relation to the first permanent magnet means, the first and the second permanent magnet means being adapted such that facing magnetic poles of the first and the second permanent magnet means are identical to each other with respect to magnetic polarity.

In another preferred embodiment, said magnetic repulsive force producing means comprises a first permanent magnet member magnetized radially of the bobbin case and secured to the periphery of the annular rib, and a second permanent magnet member magnetized radially of the looptaker and secured to the bottom of the annular groove of the looptaker, the first and second permanent magnet members being adapted such that facing magnetic poles of the first and second permanent magnet members are identical to each other with regard to magnetic polarity.

In still another preferred embodiment, said magnetic repulsive force producing means comprises a first permanent magnet member substantially constituting the annular rib and magnetized axially of the bobbin case, and second permanent magnet members, each of which is secured to an interior side of the annular groove, the first and second permanent magnet member being adapted such that facing magnetic poles of the first and second permanent magnet members are identical with each other with regard to magnetic polarity.

In a further preferred embodiment, said repulsive force producing means comprises a third permanent magnet member secured to the bottom of the track groove and extending along the first permanent magnet member, the first and third permanent magnet members being adapted such that facing magnetic poles of the first and third permanent magnet embers are identical to each other with regard to magnetic polarity.

In a still further preferred embodiment, at least one of the first and second permanent magnet members is formed in the shape of a circular arc.

In a yet further preferred embodiment, at least one of the first, second, and third permanent magnet members is formed in the shape of a circular arc.

Preferably, the first permanent magnet member comprises a plurality of first permanent magnet pieces provided at intervals circumferentially of the bobbin case.

Still preferably, the second permanent magnet member comprises a plurality of permanent magnet pieces provided at intervals circumferentially of the looptaker.

Further preferably, the third permanent magnet member comprises a plurality of magnet pieces provided at intervals circumferentially of the bobbin case.

Hence, in accordance with the invention, since the permanent magnet pieces are utilized so that the magnetic repulsive force may be produced between the annular groove of the looptaker and the annular rib of the bobbin case, sliding resistance existing therebetween may be reduced remarkably. Consequently, abrasion of those members may be prevented and high speed of rotation of the looptaker may be effected, thereby accomplishing high-speed sewing performance. Furthermore, since lubricant oil or the like is not employed, soil of thread due to such oil lubricant is prevented, thereby enabling a sewing operation to be smoothly executed.

BRIEF DESCRIPTION OF THE DRAWINGS

These and other objects, features and advantages of the invention will become more apparent upon a reading of the following detailed specification and drawings in which.

DETAILED DESCRIPTION OF THE PREFERRED EMBODIMENTS

Figure 1:
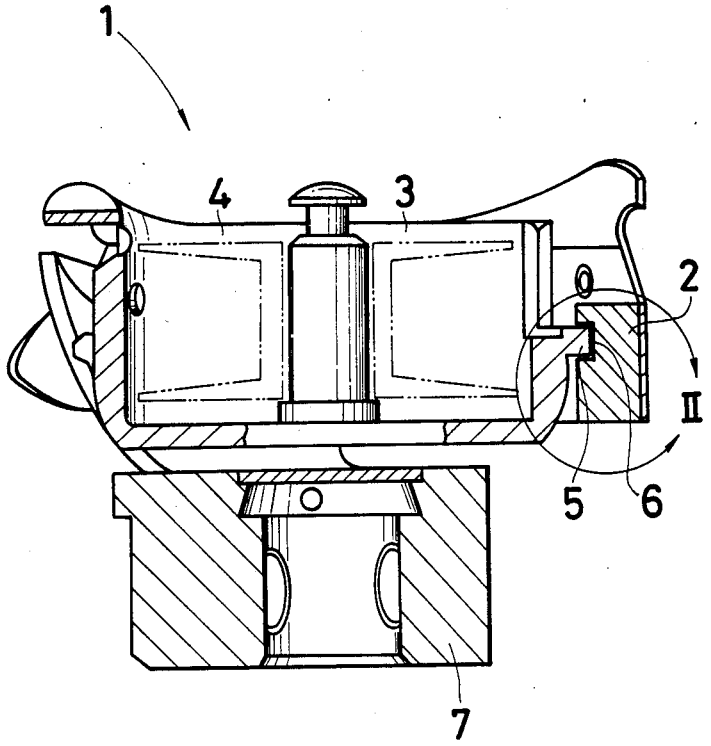
FIG. 1 is a sectional view of an embodiment of the invention.

Referring now to the drawings, preferred embodiments of the invention are described below.

FIG. 1 is a sectional view of a vertical full rotation shuttle according to an embodiment of the invention. A bobbin case 3 is accommodated in a looptaker 2. A bobbin 4 for winding bobbin thread therearound is mounted in the bobbin case 3. The bobbin case 3 is held from rotating by a rotation restraining member therefor (not shown) secured to the machine body. An annular rib 5 in the shape of an outward flange is formed on the outer periphery of the bobbin case 3. The annular rib 5 is fitted into an annular groove 6 formed on the inner periphery of the looptaker 2. The looptaker is driven to rotate about the axis thereof in one direction by a driving means connected to a rotary shaft 7.

Figure 2:
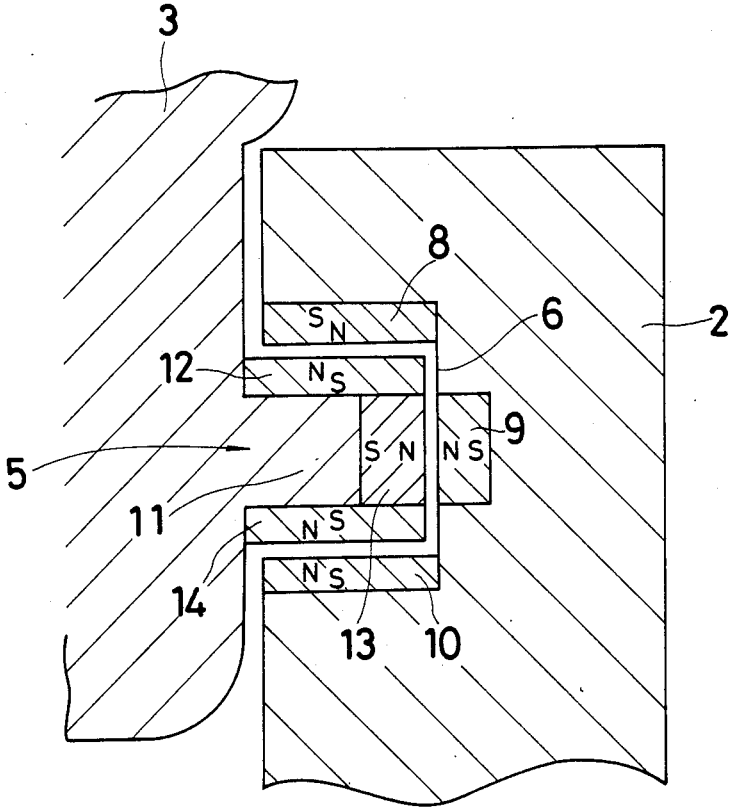
FIG. 2 is an enlarged sectional view of the portion encircled by reference numeral II of FIG. 1.
Figure 3:
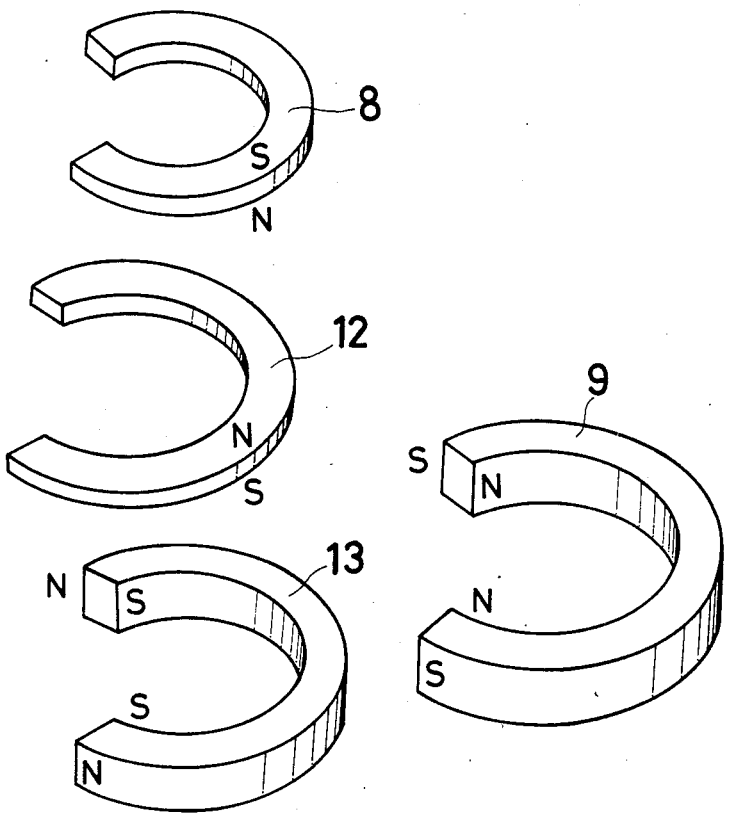
FIG. 3 is an exploded perspective view of part of the embodiment.

FIG. 2 is an enlarged sectional view showing the portion encircled by reference numeral II of FIG. 1. The looptaker 2 is made of iron, aluminum, or the like. In the annular groove 6 are fixed permanent magnets 8, 9, and 10, the fixed permanent magnet 9 being magnetized radially with respect to the axis of the looptaker and the fixed permanent magnets 8 and 10 being magnetized axially with respect to the axis of the looptaker, each of which can be formed in the shape of a circular arc, whose perspective views are shown in FIG. 3. The looptaker 2 is made of iron, aluminum, or the like as mentioned above, and accordingly is capable of having sufficient strength. Furthermore, the looptaker 2 is free from deformation which might be caused by centrifugal force while rotating at a high speed.

The bobbin case 3 is made of synthetic resin etc., and its annular rib comprises a flange part 11, and permanent magnets 12, 13, and 14, the magnet 13 being magnetized radially with respect to the axis of the looptaker and the magnets 12 and 14 being magnetized axially with respect to the axis of the looptaker, each of which can be formed in the shape of a circular arc. The opposed magnetic poles of the permanent magnet pieces 8, 12 facing each other are identical (of the same polarity) with each other. Opposite faces of magnetic pieces 9, 13 are identical to each other and each of the facing poles is a north pole in this embodiment. Opposite faces of magnetic poles of the permanent magnet pieces 10, 14 are likewise identical with each other and each of the facing poles is a north pole in this embodiment. Thus, a magnetic repulsive force is produced between the annular groove 6 and the annular rib 5. Consequently, the looptaker is capable of rotating with the annular groove 6 and the annular rib 5 hardly contacting with each other.

FIG. 2 thus shows a rotary looptaker 2 being of the type accommodating a bobbin case 3 therein, with the bobbin case 3 having an annular rib 5 in the shape of an outward flange having a radially outermost surface and upper and lower axially facing surfaces formed on an outer peripheral portion of the bobbin case, and the looptaker 2 having an annular groove 6 formed on an inner peripheral portion thereof having a radially innermost surface and upper and lower axially facing surfaces and being driven for rotation about an axis of rotation with the annular rib 5 fitted into the annular groove 6. At least one first permanent magnet 12 or 14 forms at least part of the annular rib 5 of the bobbin case 3, the at least one first permanent magnet 12 or 14 being magnetized in an axial direction with respect to the axis of rotation and having a surface thereof of one polarity, which is North in FIG. 2, forming at least part of one of the axially facing surfaces of the annular rib 5. At least one second permanent magnet 8 or 10 forms at least part of the annular groove 6 of the looptaker and the at least one second permanent magnet 8 or 10 is magnetized in the axial direction and has a surface thereof having a North polarity forming at least part of one of the axially facing surfaces of the annular groove facing the axially facing surface of the annular rib formed at least in part by the art least one first permanent magnet 12 or 14, whereby a magnetic repulsive force is generated between the annular rib the annular groove.

The embodiment shown in FIG. 2 includes at least one third permanent magnet 13 which forms at least part of the radially outermost surface of the annular rib and which is magnetized radially with respect to the axis of rotation of the looptaker. At least one fourth permanent magnet 9 forms at least part of the radially innermost surface of the annular groove 6 and is magnetized radially with respect to the axis of rotation of the looptaker. As shown in FIG. 2, the radially outermost surface of the annular rib formed by the at least one third magnet 13 is of the same polarity (North) as the radially innermost surface of the annular groove formed by the at least one fourth permanent magnet 9.

From FIG. 2 it will be seen that one first permanent magnet 12 is provided on the upper axially facing surface and another first permanent magnet 14 forms at least part of the lower axially facing surface of the annular rib, with the another first permanent magnet 14 being magnetized in an axial direction with respect to the axis of rotation of the looptaker. Likewise, in addition to the one second permanent magnet 8 provided on the upper axially facing surface of the annular groove 6, another second permanent magnet 10 is provided which has a surface forming at least part of the lower axially facing surface of the annular groove, the another second permanent magnet 10 being magnetized in an axial direction with respect to the axis of rotation.

Figure 4:
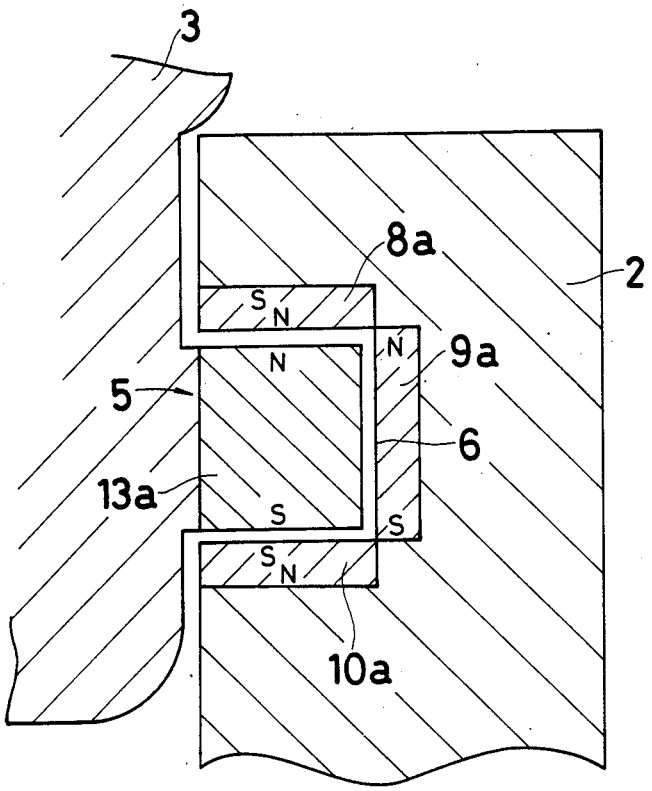
FIG. 4 is a sectional view of another embodiment of the invention.

FIG. 4 is a sectional view of another embodiment of the invention. In this embodiment, permanent magnet pieces 8*a* and 10a are secured to the sides of annular groove 6 of looptaker 2 and piece 9*a* is secured to the bottom of the annular groove of the looptaker 2. The annular rib 5 of the bobbin case 3 is formed by a permanent magnet piece 13*a* which is magnetized axially of the bobbin case 3. The permanent magnet piece 13*a* is adapted such that its magnetic poles are identical with those magnetic poles of the permanent magnet pieces 8*a*, 9*a*, 10*a* which face the magnetic poles of the permanent magnet piece 13*a*. Consequently, a magnetic repulsive force acts between the annular groove 6 and the annular rib 5. Other construction of this embodiment is similar to that of the previous embodiment.

The embodiment shown in FIG. 4 thus comprises a single first permanent magnet 13*a* which forms at least part of the upper and lower axially facing surfaces of the annular rib 5, the single first permanent magnet 13*a* being magnetized in an axial direction with respect to the axis of rotation of the looptaker and having the portion thereof forming at least part of the upper axially facing surface of one polarity (North) and the portion thereof forming at least part of the lower axially facing surface of the opposite polarity (South). A second permanent magnet 8*a* is provided having a surface of the one polarity (North) forming at least part of the upper axially facing surface of the annular groove, the second permanent magnet 8*a* being magnetized in an axial direction with respect to the axis of rotation of the looptaker. Another second permanent magnet 10*a* is provided having a surface of the opposite polarity (South) forming at least part of the lower axially facing surface of the annular groove, the another second permanent magnet 10*a* being magnetized in an axial direction with respect to the axis of rotation of the looptaker. In addition, at least one permanent magnet 9*a* is provided forming at least part of the radially innermost surface of the annular groove 6, the magnet 9*a* being magnetized axially with respect to the axis of rotation of the looptaker.

Figure 5:
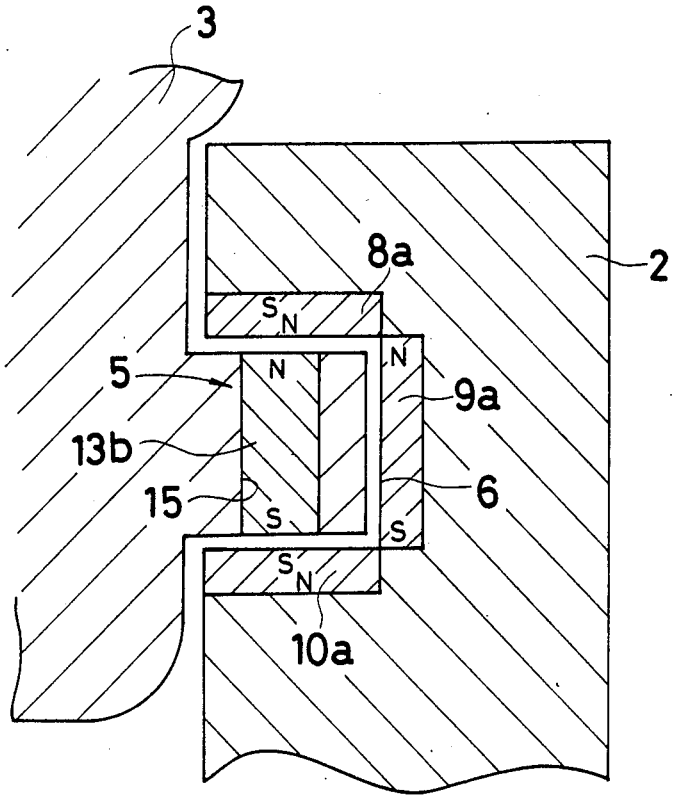
FIG. 5 is a sectional view of still another embodiment of the invention.

FIG. 5 is a sectional view of still another embodiment of the invention. Although this embodiment is similar to that shown in FIG. 4, it is noteworthy in this embodiment that a fixing hole 15 is formed in the annular rib 5 of the bobbin case 3 and a permanent magnet piece 13*b* is fixed into the fixing hole 15. The permanent magnet pieces 8*a*, 9*a*, and 10*a* are each formed in the shape of a circular arc as shown in FIG. 3. The permanent magnet piece 13*b* is bar-shaped, extending in the axial direction of the bobbin case (in the vertical direction as viewed in FIG. 5). Such permanent magnet pieces 13*b* are disposed at intervals in the circumferential direction around the bobbin case 3. Such an arrangement as mentioned above also produces the magnetic repulsive force between the annular groove 6 and the annular rib 5.

The embodiment shown in FIG. 5 thus shows at least one first permanent magnet 13*b* which forms at least part of the upper and lower axially facing surfaces of the annular rib, the at least one first permanent magnet 13*b* being magnetized in an axial direction with respect to the axis of rotation of the looptaker and having the portion thereof forming at least part of the upper axially facing surface of North polarity and the portion thereof forming at least part of the lower axially facing surface of South polarity. As mentioned above, a plurality of first permanent magnets 13*b* are provided at intervals in the circumferential direction of the bobbin case and each magnet 13*b* extends axially through the annular rib and is spaced radially inward from the radially outermost surface of the annular rib. At least one second permanent magnet 8*a* is provided having a surface of North polarity forming at least part of the upper axially facing surface of the annular groove, the second permanent magnet 8a being magnetized in an axial direction with respect to the axis of rotation of the looptaker. Another second permanent magnet 10*a* is provided having a surface of South polarity forming at least part of the lower axially facing surface of the annular groove, the another second permanent magnet 10*a* being magnetized in an axial direction with respect to the axis of rotation of the looptaker. At least one permanent magnet 9*a* is provided forming at least part of the radially innermost surface of the annular groove, the magnet 9*a* being magnetized axially with respect to the axis of rotation of the looptaker.

Figure 6:
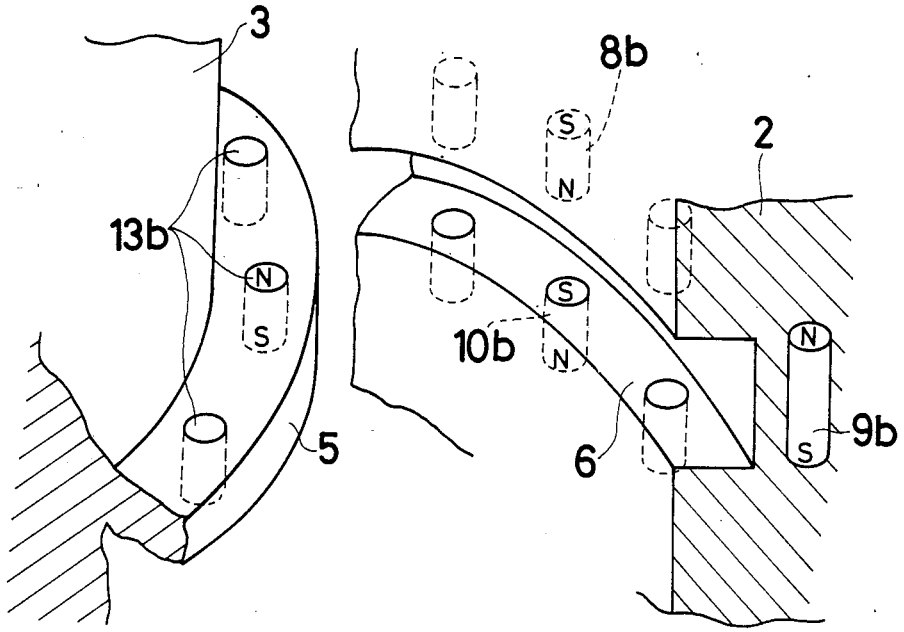
FIG. 6 is a perspective view of part of yet another embodiment of the invention.

FIG. 6 is a perspective view showing part of yet another embodiment of the invention. In this embodiment, permanent magnet pieces 8*b*, 9*b*, 10*b* are buried in the looptaker 2 at intervals circumferentially around the looptaker. The permament magnet pieces 13*b* fixed in the bobbin case 3 are the same as that in the previous embodiment shown in FIG. 5. Likewise in this embodiment, friction contact of the permanent magnet pieces 13*b* with permanent magnet pieces 8*b*, 9*b* and 10*b* is resisted by the magnetic repulsive force acting therebetween.

The embodiment shown in FIG. 6 thus shows a plurality of first permanent magnets 13*b* each of which form a part of the annular rib of the bobbin case, each of the plurality of first permanent magnets 13*b* being magnetized in the axial direction and each of the plurality of first permanent magnets 13*b* having a surface thereof of North polarity forming a part of the upper axially facing surface of the annular rib. A plurality of second permanent magnets 8*b* each form a part of the annular groove of the looptaker, each of the plurality of second permanent magnets 8*b* being magnetized in the axial direction and each of the plurality of second permanent magnets 8*b* having a surface thereof of North polarity forming a part of the upper axially facing surface of the annular grove. Also, each of the plurality of first permanent magnets 13*b* have another surface of South polarity forming a part of the lower axially facing surface of the annular rib, and another plurality of the second permanent magnets 10*b* each form a part of annular groove of the looptaker, each of the another plurality of second permanent magnets 10*b* being magnetized in the axial direction and having a surface thereof of Sourth polarity forming a part of the lower axially facing surface of the annular groove. A plurality of third permanent magnets 9*b* are disposed in the looptaker, each of the plurality of third permanent magnets 9*b* being magnetized in the axial direction and spaced at intervals circumferentially around the looptaker and spaced radially from the radially innermost surface of the annular groove.

The present invention can be applied to a horizontally rotary looptaker and a semirotary looptaker as well as a vertically full-rotary looptaker.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the means and the range of equivalency of the claims are therefore intended to be embraced therein.

What is claimed is:

1. In a rotary looptaker being of the type accommodating a bobbin case therein, said bobbin case having an annular rib in the shape of an outward flange having a radially outermost surfaces and upper and lower axially facing surfaces formed on an outer peripheral portion of said bobbin case, and said looptaker having an annular groove formed on an inner peripheral portion thereof having a radially innermost surface and upper and lower axially facing surfaces and being driven for rotation about an axis of rotation with said annular rib fitted into said annular groove, the improvement comprising:

at least one first permanent magnet forming at least part of said annular rib of said bobbin case, said at least one first permanent magnet being magnetized in an axial direction with respect to said axis of rotation and having a surface thereof of one polarity forming at least part of one of said axially facing surfaces of said annular rib; and at least one second permanent magnet forming at least part of said annular groove of said looptaker and said at least one second permanent magnet being magnetized in said axial direction and having a surface thereof of said one polarity forming at least part of one of said axially facing surfaces of said annular groove facing said axially facing surface of said annular rib formed at least in part by said surface of said one polarity of said at least one first permanent magnet, whereby a magnetic repulsive force is generated between said annular rib and said annular groove.

2. The improvement claimed in claim 1, further comprising at least one third permanent magnet forming at least part of said radially outermost surface of said annular rib and being magnetized radially with respect to said axis of rotation.

3. The improvement claimed in claim 2, further comprising at least one fourth permanent magnet forming at least part of said radially innermost surface of said annular groove and being magnetized radially with respect to said axis of rotation.

4. The improvement claimed in claim 3, wherein said radially outermost surface of said annular rib formed by said at least one third magnet is of the same polarity as said radially innermost surface of said annular groove formed by said at least one fourth permanent magnet.

5. The improvement of claim 1, further comprising at least another first permanent magnet having a surface of said one polarity forming at least part of the other one of said axially facing surfaces of said annular rib, said another first permanent magnet being magnetized in an axial direction with respect to said axis of rotation.

6. The improvement of claim 5, further comprising at least another second permanent magnet having a surface of said one polarity forming at least part of the other one of said axially facing surfaces of said annular groove, said another second permanent magnet being magnetized in an axial direction with respect to said axis of rotation.

7. The improvement claimed in claim 6, further comprising at least one third permanent magnet forming at least part of said radially outermost surface of said annular rib and being magnetized radially with respect to said axis of rotation.

8. The improvement claimed in claim 7, further comprising at least one fourth permanent magnet forming at least part of said radially innermost surface of said annular groove and being magnetized radially with respect to said axis of rotation.

9. The improvement claimed in claim 8, wherein said radially outermost surface of said annular rib formed by said at least one third magnet is of the same polarity as said radially innermost surface of said annular groove formed by said at least one fourth permanent magnet.

10. The improvement of claim 1, wherein a single first permanent magnet forms at least prat of said upper and lower axially facing surfaces of said annular rib, said single first permanent magnet being magnetized in an axial direction with respect to said axis of rotation and having the portion thereof forming at least part of one of said axially facing surfaces of said one polarity and the portion thereof forming at least part of the other of said axially facing surfaces of the opposite polarity.

11. The improvement of claim 10, further comprising at least another second permanent magnet having a surface of said opposite polarity forming at least part of the other one of said axially facing surfaces of said annular groove, said another second permanent magnet being magnetized in an axial direction with respect to said axis of rotation.

12. The improvement claimed in claim 11, further comprising at least one permanent magnet forming at least part of said radially innermost surface of said annular groove and being magnetized axially with respect to said axis of rotation.

13. The improvement of claim 1, wherein said at least one first permanent magnet forms at least part of said upper and lower axially facing surfaces of said annular rib, said at least one first permanent magnet being magnetized in an axial direction with respect to said axis of rotation and having the portion thereof forming at least part of one of said axially facing surfaces of said one polarity and the portion thereof forming at least part of the other of said axially facing surfaces of the opposite polarity.

14. The improvement of claim 13, wherein said at least one first permanent magnet comprises a plurality of first permanent magnets each of which extends axially through said annular rib and is spaced radially inward from said radially outermost surface of said annular rib.

15. The improvement of claim 13, further comprising at least another second permanent magnet having a surface of opposite polarity forming at least part of the other one of said axially facing surfaces of said annular groove, said another second permanent magnet being magnetized in an axial direction with respect to said axis of rotation.

16. The improvement claimed in claim 13, further comprising at least one permanent magnet forming at least part of said radially innermost surface of said annular groove and being magnetized axially with respect to said axis of rotation.

17. The improvement of claim 1, wherein a plurality of first permanent magnets each form a part of said annular rib of said bobbin case, each of said plurality of first permanent magnets being magnetized in said axial direction and each of said plurality of first permanent magnets having a surface thereof of said one polarity forming a part of one of said axially facing surfaces of said annular rib; and, a plurality of second permanent magnets each form a part of said annular groove of said looptaker, each of said plurality of second permanent magnets being magnetized in said axial direction and each of said plurality of second permanent magnets having a surface thereof of said one polarity forming a part of said one of said axially facing surfaces of said annular groove facing said one of said axially facing surfaces of said annular rib.

18. The improvement of claim 17, wherein each of said plurality of first permanent magnets have another surface of opposite polarity forming a part of the other one of said axially facing surfaces of said annular rib and, another plurality of said second permanent magnets each form a part of the other one of said axially facing surfaces of said annular groove, each of said another plurality of second permanent magnets being magnetized in said axial direction and having a surface thereof of said opposite polarity forming said part of the other one of said axially facing surfaces of said annular groove facing said other one of said axially facing surfaces of said rib.

19. The improvement of claim 17, further comprising a plurality of third permanent magnets disposed in said looptaker, each of said plurality of third permanent magnets being magnetized in said axial direction and spaced at intervals circumferentially around said looptaker and spaced radially from said radially innermost surface of said annular groove.

20. The improvement of claim 1, wherein said at least one first permanent magnet is in the shape of a circular arc and said at least one second permanent magnet is in the shape of a circular arc.

21. The improvement of claim 3, wherein said at least one third permanent magnet is in the shape of a circular arc and said at least one fourth permanent magnet is in the shape of a circular arc.

* * * * *